US005580393A

United States Patent [19]

Lawther

[11] Patent Number: 5,580,393

[45] Date of Patent: Dec. 3, 1996

[54] APPARATUS AND METHOD FOR REMOVING UNDESIRED COATINGS FROM THE INTERIOR OF TUBES

[76] Inventor: Gerald H. Lawther, 302 4743 River Road West, Ladner BC, Canada, V4K 1R9

[21] Appl. No.: 374,676

[22] PCT Filed: Aug. 3, 1993

[86] PCT No.: PCT/CA93/00313

§ 371 Date: Jan. 24, 1995

§ 102(e) Date: Jan. 24, 1995

[87] PCT Pub. No.: WO94/03285

PCT Pub. Date: Feb. 17, 1994

[30] Foreign Application Priority Data

Jul. 31, 1992 [CA] Canada ..... 2075089

[51] Int. Cl.[6] ..... B08B 9/04

[52] U.S. Cl. ..... 134/8; 134/22.11; 134/24; 134/167 C; 15/104.07; 15/104.31

[58] Field of Search ..... 134/8, 22.11, 24, 134/167 C; 15/104.31, 104.07, 104.05, 104.16

[56] References Cited

U.S. PATENT DOCUMENTS

| | | | |
|---|---|---|---|
| 13,032 | 11/1909 | Greenan | 15/104.31 X |
| 4,011,100 | 3/1977 | Ross | 134/24 X |
| 4,337,096 | 6/1982 | Clifford | 134/8 |
| 4,981,524 | 1/1991 | Waite | 134/24 |
| 5,122,193 | 6/1992 | Derlein | 134/22.11 |
| 5,146,644 | 9/1992 | Crocco | 15/103.31 X |
| 5,336,333 | 8/1994 | Sheppard et al. | 15/104.31 X |
| 5,364,473 | 11/1994 | Van Der Does | 134/8 |

*Primary Examiner*—Jill Warden
*Assistant Examiner*—Saeed T. Chaudhry
*Attorney, Agent, or Firm*—Dean A. Craine

[57] ABSTRACT

A method of removing undesired coatings from the interior surface of tubes includes inserting a fluid-dynamically unstable impact head into the tube, providing or maintaining fluid flow through the tube and altering the length of a tether attached to the impact head to move the impact head along the tube. As a result of the fluid flow, the impact head moves chaotically within the tube, impacting the interior surface of the tube and removing undesired coatings therefrom. An apparatus for accomplishing the method preferably includes an impact head, a flexible retaining line and a carriage moveable within the tube, the carriage aiding in the centering of the retaining line.

23 Claims, 4 Drawing Sheets

APPARATUS AND METHOD FOR REMOVING UNDESIRED COATINGS FROM THE INTERIOR OF TUBES

TECHNICAL FIELD

The present invention relates to the removal of undesired coatings from the interior surfaces of tubes. More specifically, the present invention provides a novel method and apparatus for the removal of various undesired coatings from the interior of tubes.

BACKGROUND ART

In many systems employing tubes, the interior surface of the tube will, through the course of normal use, become fouled with one or more undesired coatings. Examples of such undesired coatings include: various hard tars and residuals from petroleum products in oil pipelines; mineral scale in pipes of heat exchangers; rust or other corrosion byproducts in water (and other fluid) pipes; and plaque in veins or arteries of living beings. Such coatings typically result in a reduction of the performance of the system of which the tube forms a part. For example the performance of a heat exchanger may be degraded, a loss of pressure head may occur in a pumping system, or a reduction in flow through the tube may occur in an inlet system.

A particularly troublesome problem which has recently caused much concern is that of infestation of water inlet pipes by zebra mussels. Zebra mussels are small aquatic mussels, native to portions of Europe, which have recently been found in the St. Lawrence Seaway and in the Great Lakes of North America. Zebra mussels have a high rate of reproduction and have no known natural predators in North America. The zebra mussels attach themselves to underwater surfaces and feed by filtering organic materials from the surrounding water. Accordingly, they are particularly attracted to locations such as boat bottoms and the water inlet tubes of power plants, factories and municipal water treatment plants where water flows are prevalent.

A water inlet tube, such as that providing water to one of the above-mentioned power plants, factories or municipal water treatment plants, becomes infested when one or more zebra mussels affix themselves to the interior of the tube and begin to reproduce. The number of zebra mussels quickly rises and they will coat, and eventually block, the interior of the tube substantially reducing or even stopping the water flow through the tube.

It has proven to be difficult to remove zebra mussels from the interior of tubes in an efficient manner. Often it is required to stop flow through the infested tube and to manually scrape the mussels off the interior of the tube. This is an expensive and time consuming process and may often be impractical or difficult to accomplish depending upon the diameter of and ease of access to the tube. Further, in certain circumstances, the exact location of the zebra mussel blockage is not always readily apparent. These problems are further exacerbated by the fact that it is preferable to remove the mussels from the interior of the tubes at regular intervals rather than waiting for the system performance to degrade significantly before removing the mussels. Accordingly, this results in the requirement to remove the mussels several times a year.

Alternatives other than manual scraping have been proposed including the use of power driven crawlers which move through the tube mechanically scraping the mussels away. Unfortunately, such power driven systems include many moving parts and are expensive to manufacture and maintain. Further, such crawlers generally require that the flow through the tube be stopped and thus disposal of the mussels removed from the surface of the tube becomes a problem as a pump or other removal means must be provided.

DISCLOSURE OF THE INVENTION

It is an object of the present invention to provide a novel method to remove undesired coatings from the interior surface of tubes.

It is a further object of the present invention to provide a novel apparatus for removing undesired coatings from the interior surface of tubes.

According to a first aspect of the present invention, there is provided a method of removing a coating from the interior surface of a tube through which fluid flows comprising the steps of: placing a fluid-dynamically unstable impact head within the tube which impacts the interior of the tube as a result of the fluid flow thereby to remove the coating; and controlling the movement of the head along a length of the tube.

According to another aspect of the present invention, there is provided an apparatus for removing a coating from the interior surface of a tube through which fluid flows comprising: a fluid-dynamically unstable impact head; and a flexible restraining means connected to said impact head.

As used throughout this specification, the term "tube" is meant to encompass concrete, metal or plastic pipes and other vessels for containing a fluid flow. While it is believed that the majority of such tubes will have a circular cross-section, the present invention is not limited to use in tubes with circular cross-sections and can be used in tubes with other cross-section shapes such as square or oval.

Further, as used throughout this specification, the term "undesired coatings" includes materials such as chemical or organic materials and substances such as mussels, barnacles, algae, seaweed, milfoil and rust or mineral scale, which are generally not desired. The term "undesired coatings" also includes coatings which are undesired due to their location and not their composition. An example of the latter type of coating would be the product of a chemical reaction occurring within the tube wherein the product must be removed from the tube before it is useful. In this instance, the product is undesired when it is on the interior surface of the tube but is desired once it is removed from the tube. It will be appreciated that the term "coating" is used in the broad sense and encompasses the case were the material being removed is distributed sporadically or unevenly on the interior surface of the tube.

BRIEF DESCRIPTION OF THE DRAWINGS

Embodiments of the present invention will be described with reference to the accompanying drawings, in which.

BEST MODE FOR CARRYING OUT THE INVENTION

Figure 1:
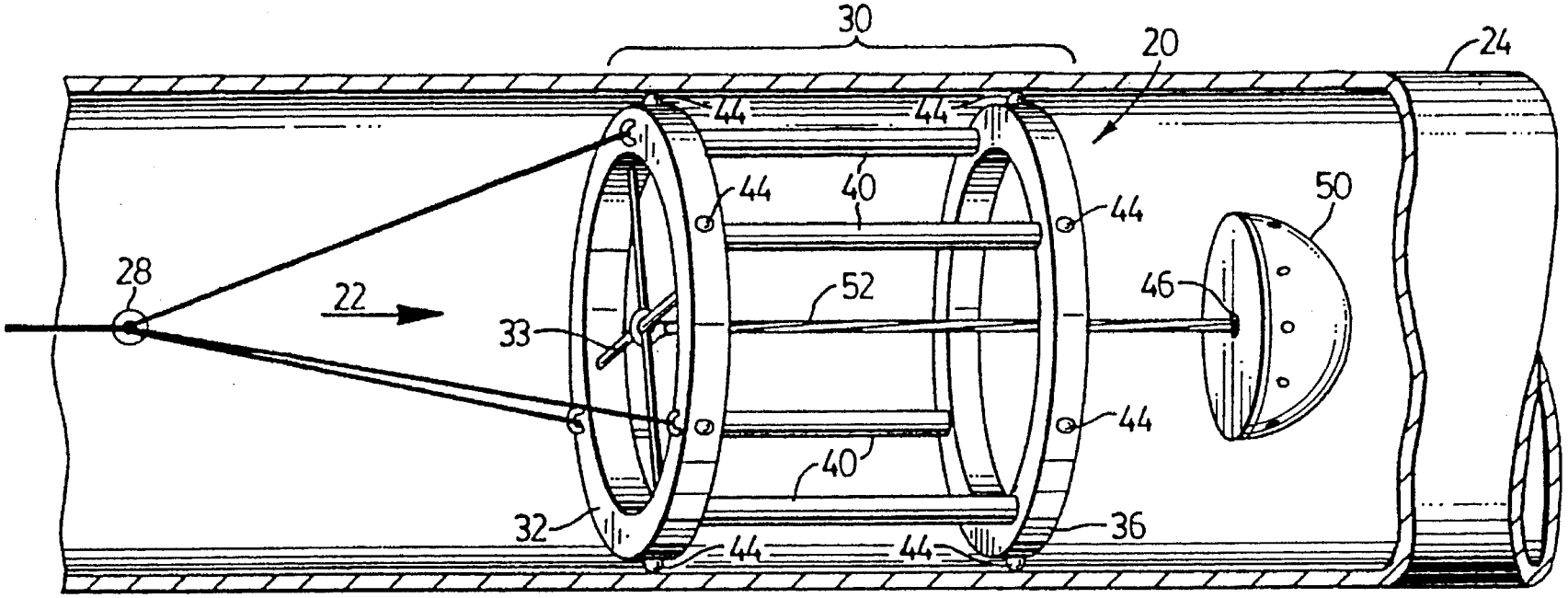
FIG. 1 illustrates an apparatus for removing an undesired coating from the interior of a tube.

With reference to FIG. 1, an apparatus for removing undesired coatings in accordance with the present invention is illustrated generally at 20. Apparatus 20 is shown in place in the interior of a pipe 24 with the direction of the fluid flow through the tube being indicated by arrow 22 which points in the downstream direction. Non-limiting examples of suitable fluids comprise liquids, gases and super-heated steam. Preferably, the apparatus 20 includes a carriage 30 attached to a tether 28. Carriage 30 comprises first and second annular aligning members 32 and 36, respectively, four spacer members 40 extending between the aligning members 32,36 and six rollers 44 on each aligning member 32 and 36.

Each roller 44 is resiliently mounted to its corresponding aligning member 32,36 and the diameter of the aligning members 32,36 is such that the rollers 44 engage the interior surface of the tube and allow carriage 30 to easily move along the interior of pipe 24. To minimize yawing of carriage 30 within the tube, it is preferred to adjust the length of spacer members 40 such that the ratio of the distance between aligning members 32,36 to the diameter of the interior of pipe 24 is at least about 1.5, although shorter lengths may sometimes be desired, especially to accommodate tubes with large numbers of elbows or curved portions.

The resilient mounting of rollers 44 acts to accommodate irregularities in the tube interior, such as those due to joints or welds. As will be understood by those of skill in the art, rollers 44 may be of any suitable design, such as a self-lubricating nylon roller or a sealed roller-ball unit.

Figure 2:
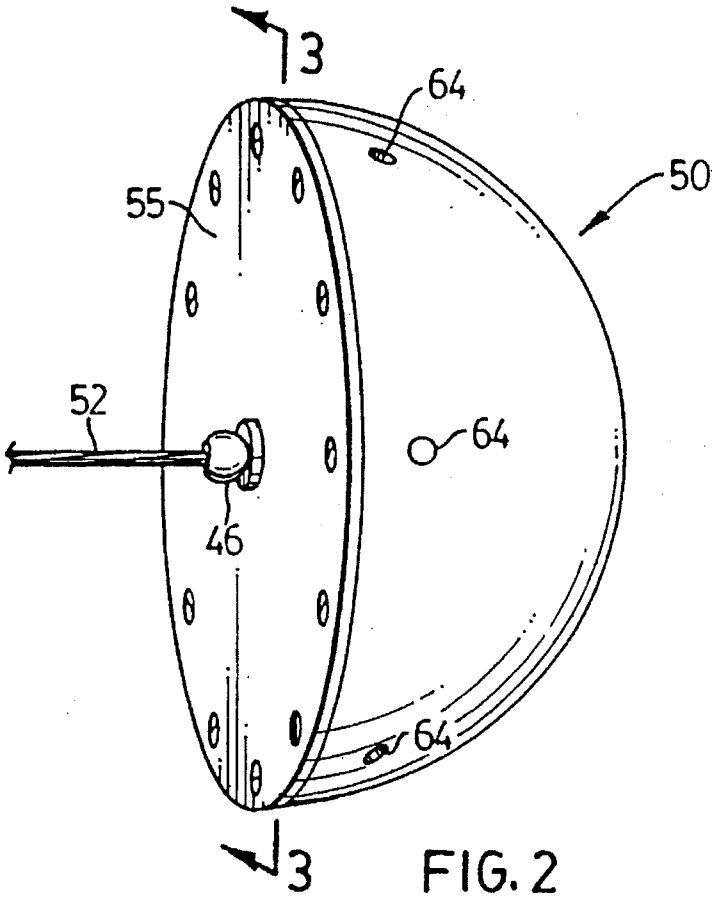
FIG. 2 illustrates a perspective view of an impact head used in the apparatus of FIG. 1.

Aligning member 32 has an X-shaped frame member 33 mounted across its center and to which a restraining cable 52 is attached. The other end of restraining cable 52 is connected to a swivel 46 which is in turn connected to an impact head 50. Specifically, as best seen in FIG. 2, the downstream end of restraining cable 52 terminates at swivel 46 which is attached to the center of a face plate 55 of impact head 50. In this manner, restraining cable 52 allows lateral movement of impact head 50 and swivel 46 allows free rotation of impact head 50 about restraining cable 52.

Figure 3:
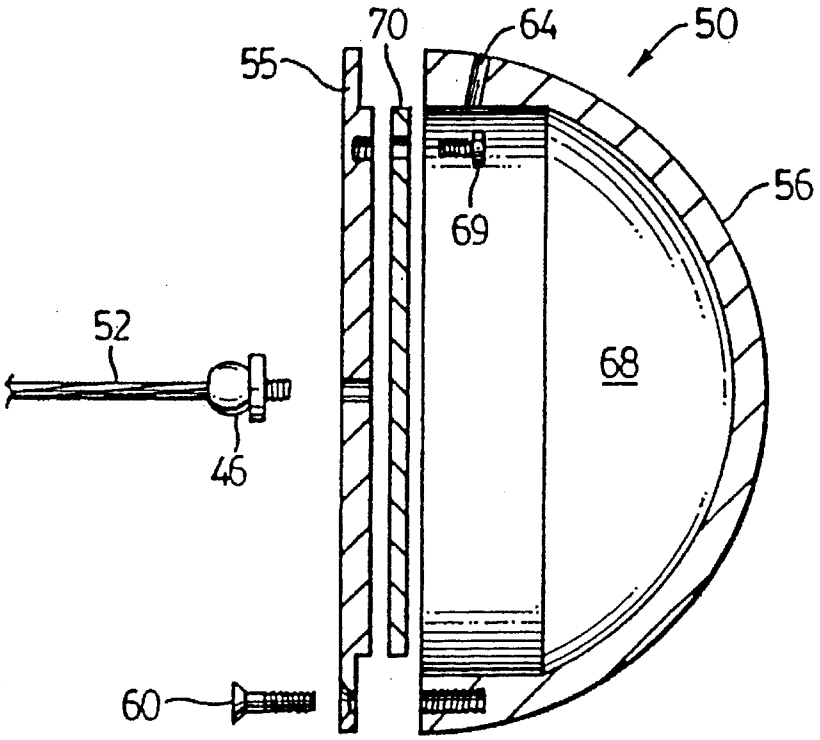
FIG. 3 illustrates a section taken along line 3—3 of FIG. 2.

As shown in FIG. 3, it is preferred that impact head 50 be in the form of a hollow spherical portion 56 and a face plate 55 which is mounted to the spherical portion 56 in any suitable manner, such as by screws 60. Preferably, the spherical portion 56 is substantially a hemisphere as this maximizes the diameter of the face plate 55 for a given diameter of spherical portion 56.

The hemispherical shape is preferred as it results in a D-shaped cross-section of impact head 50, taken along a plane parallel to the direction of fluid flow through the tube. As will be understood by those of skill in the art, such a D-shaped cross-section results in the formation of shedding eddies at the trailing, downstream, edge of impact head 50 and these shedding eddies assist in producing the preferred chaotic movement of impact head 50. It should be understood that, while the D-shaped cross-section is preferred, it is not essential to the operation of the present invention and it is contemplated that other shapes may be employed although they may suffer a reduced level of performance. For example, it is contemplated that face plate 55 could be convex or that portion 56 could be ellipsoidal.

Impact head 50 may be formed of any suitable material, such as fibreglass, ABS plastic, steel, etc. and, when used in tubes with circular cross-sections, preferably has a diameter in the range of from about 40 to about 80 percent of the interior diameter of pipe 24. When used in tubes with other than a circular cross-section, it is preferred that impact head 50 have a cross-sectional area, normal to the fluid flow, of from about 50 to about 75 percent of the cross-sectional area of the tube. In the later case, it will be understood that in tubes with sharp vertices, such as in tubes with square cross-sections, the undesired coating in areas immediately adjacent the vertices may not be removed to the same degree as a similar coating in a circular cross-sectioned tube. It is contemplated however, that in most circumstances such areas of unremoved coating will be easily tolerated but this determination can be made by those of skill in the art.

While not essential, it is preferred that impact head 50 be substantially neutrally buoyant within the fluid in pipe 24 for best results. Depending on the material from which spherical portion 56 and face plate 55 are fabricated, the buoyancy of impact head 50 may be adjusted through the addition of weights or buoyant material or both. Such weights may conveniently be formed into a circular or annular plate 70 and attached to the back of face plate 55 by any suitable manner such as screws 69. If weights are added, it is further contemplated that by forming the plate 70 as an annulus, the moment of inertia of impact head 50 will be favourably improved as is described below. If buoyant material is to be added to impact head 50, such material can be inserted into cavity 68, or attached to face plate 55 as required.

To maintain the buoyancy characteristics of impact head 50 independent of the working fluid in pipe 24, a series of apertures 64 are provided to allow the fluid in pipe 24 to enter cavity 68. It should be understood that, while the impact head described above is an assembly of various components, it is contemplated that under some circumstances it will be desired to employ a single-piece, solid impact head.

As will be understood by those of skill in the art, the above-described combination of impact head 50 and restraining cable 52 results in impact head 50 being fluid-dynamically unstable within pipe 24. Specifically, as the fluid in pipe 24 flows past impact head 507 it induces turbulence about impact head 50 due to the D-shaped section of impact head 50, when viewed normal to the direction of the fluid flow, and this turbulence serves to move impact head 50 in a chaotic manner within pipe 24. The exterior surface of the spherical portion 56 of impact head 50 is thus repeatedly brought into contact with the interior of pipe 24 as a result of the chaotic movement.

It is important to note that the above-described impact head 50 is fluid-dynamically unstable and undergoes chaotic movement even in the presence of otherwise laminar fluid flow within the pipe 24. This fluid-dynamic instability is a function of the shape, size and method of attachment of impact head 50.

The chaotic movement of impact head 50 results in a largely random motion of impact head 50, with impact head 50 essentially pivoting or swinging about a length of restraining cable 52. As the upstream end of restraining cable 52 is centered within pipe 24, this pivoting action tends to occur about the center point of pipe 24 and, over time, an annular region of the interior of pipe 24 adjacent the impact head 50 is impacted and the undesired coating is removed from the interior surface of the pipe within that annular region. As carriage 30 is moved through pipe 24, the annular region which is impacted moves correspondingly through pipe 24.

In use, apparatus 20 is inserted into the upstream end of a tube, such that impact head 50 is downstream of carriage 30. Rollers 44 movably engage the interior surface of pipe 24 and allow easy movement of the apparatus through the tube. The fluid flow in pipe 24 induces impact head 50 to move chaotically and to impact the interior surface of pipe 24. When used in systems such as water intakes, it is contemplated that there will be no requirement to stop flow through pipe 24 when the apparatus is being inserted and thus the operation of the apparatus could be initiated without requiring any alteration in the operation of the inlet system.

The drag which is produced on apparatus 20 by the fluid flow past it urges the apparatus downstream in pipe 24 and is countered by the tension of tether 28. By paying out tether 28 at an appropriate rate against the drag, the apparatus moves downstream in pipe 24 with the annular region cleaned by impact head 50 being swept along the interior of pipe 24. Alternatively, tether 28 can be shortened by a windlass or in another suitable manner to move the apparatus against the direction of fluid flow in pipe 24. In this latter case the apparatus would be inserted at the outlet end of the pipe and drawn upstream through pipe 24 against the fluid flow by tether 28. The operation of the apparatus is essentially unchanged in this case, with impact head 50 still being located downstream of restraining cable 52 and carriage 30.

The rate at which the apparatus is moved through pipe 24 is selected to ensure that sufficient impacts occur in an annular region to obtain the desired degree of coating removal prior to the apparatus moving to another annular region. This can be accomplished by moving the apparatus step-wise through the pipe 24 or, preferably, by moving the apparatus at a steady rate no faster than the maximum rate which ensures sufficient impacts occur within the annular region.

Carriage 30 serves primarily to maintain the upstream end of restraining cable 52 at a point close to the center of pipe 24. This ensures that the impacts of impact head 50 occur substantially evenly about the annular region of the interior of pipe 24 as impact head 50 pivots about the center point of pipe 24. As apparatus 20 moves past bends and curves in pipe 24, the upstream end of restraining cable 52 is maintained substantially centered within pipe 24 by carriage 30.

It is also contemplated that in some circumstances such a carriage will be neither desired nor required. In such circumstances, correct operation of the apparatus can also be achieved without carriage 30 by attaching restraining cable 52 directly to tether 28 or by making cable 52 and tether 28 one component. While not essential, it is preferred that restraining cable 52 be substantially neutrally buoyant in the working fluid to minimize drag of restraining cable against the side of pipe 24. In the circumstance that restraining cable 52 is not completely neutrally buoyant, it has been found that the chaotic movement of impact head 50 serves to maintain restraining cable 52 substantially centered within pipe 24.

However, in such a carriage-less situation the restraining cable 52 will not be centered immediately downstream of any bends in pipe 24. This can result in the coating on the interior surface of pipe 24 immediately downstream from such bends not being removed as well as may otherwise be desired. Of course, once impact head 50 has moved a sufficient distance from such a bend, the restraining cable 52 will again become centered to ensure proper removal of the undesired coating on the interior of pipe 24.

The characteristics of impact head 50 can be tuned as required. For example, the buoyancy of the impact head may be adjusted by adding weights or buoyant materials to impact head 50 as described above. Further, when adding weights or buoyant materials, the position of the weights and buoyant materials may be varied as required to obtain a preferred moment of inertia, center of gravity and center of buoyancy for impact head 50.

Specifically, by adding weight close to the periphery of face plate 55, such as by using an annular plate 70, the impact force produced by impact head 50 for a given flow rate will be increased. Alternatively, adding the weight close to the center of face plate 55, such as by employing a circular plate 70 with a diameter small in relation to the diameter of face plate 55, reduces the force of the impact produced.

Also, with the weight located adjacent face plate 55, it is the upstream edge of impact head 50 which tends to contact the interior surface of pipe 24. By spacing the weight downstream from faceplate 55, the contact between the impact head 50 and the interior surface of pipe 24 tends to occur along the side of spherical portion 56. Such spacing can be accomplished for example, by attaching a cylindrical weight extending normal to, in the downstream direction, and from the center of face plate 55 instead of plate 70. It is contemplated that various combinations of the above-mentioned and other alternatives will be useful in different circumstances, as will be apparent to those of skill in the art.

In this manner, the performance characteristics of the impact head 50 can be selected as desired to meet the particular requirements of the undesired coating and the tube.

Figure 4:
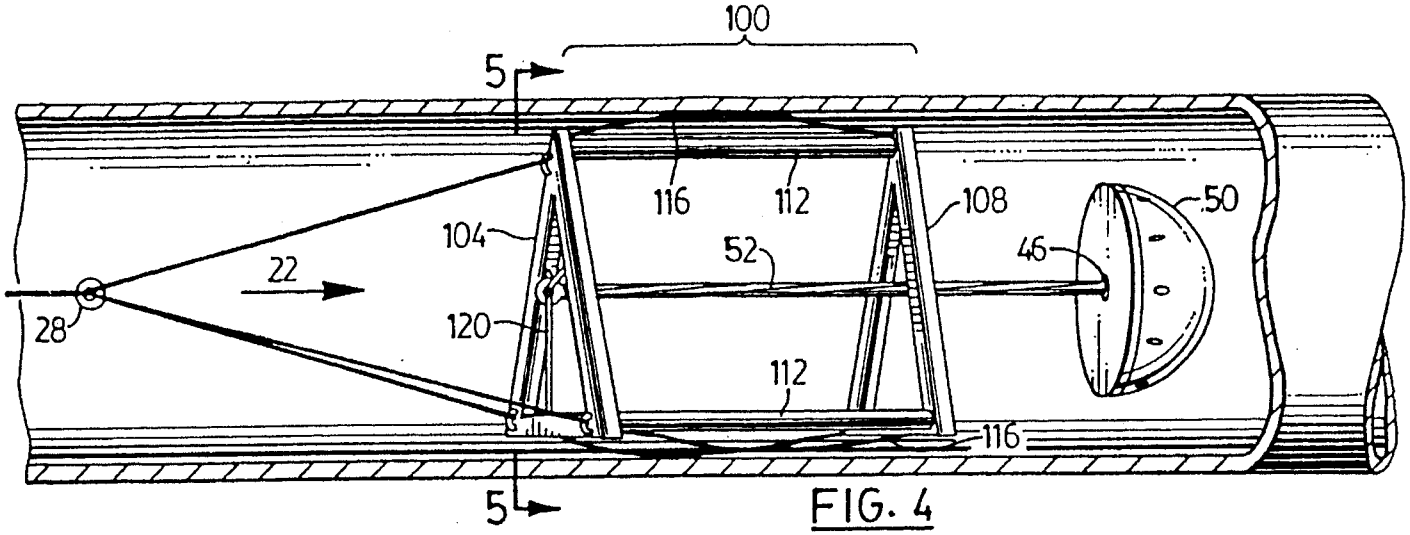
FIG. 4 illustrates a perspective view of another embodiment of an apparatus for removing an undesired coating from the interior of a tube.
Figure 5:
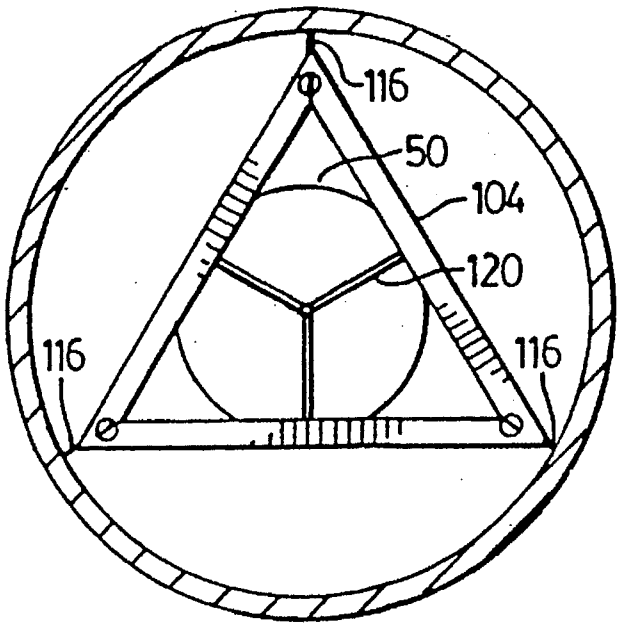
FIG. 5 illustrates a section taken along line 5—5 of FIG. 4.

FIGS. 4 and 5 illustrate another embodiment of the present invention wherein components similar to those of the previous embodiment are identified by the same reference numerals. In this embodiment, carriage 30 is replaced by slider frame 100. Slider frame 100 comprises a pair of triangular frames 104,108 whose vertices are joined by spacers 112. Each spacer 112 further includes a spring member 116 which preferably comprises a strip of spring steel, or the like, and whose ends are attached to spacer 112 to form a resilient bow on each spacer 112 adjacent the interior surface pipe 24. Spring members 116 resiliently engage the interior surface of pipe 24 to allow slider frame 100 to move relatively freely therethrough. A Y-shaped frame 120 is attached to the upstream triangular frame 104 with restraining cable 52 attached to its center point.

It is contemplated that the use of slider frame 100 will avoid difficulties in ensuring proper operation of rollers 44 which may occur in some environments such as those wherein corrosive fluids are employed or wherein pipe 24 may have a particularly abrasive interior surface which could damage rollers 44. Furthermore, it is contemplated that slider frame 100 may be relatively easily adjusted to fit tubes of different interior diameters.

Specifically, each triangular frame 104,108 may be fabricated from three pairs of complementary male and female threaded members. By altering the engagement of each male and female pair, the frames can be sized to appropriately engage tubes of different diameters.

Figure 6:
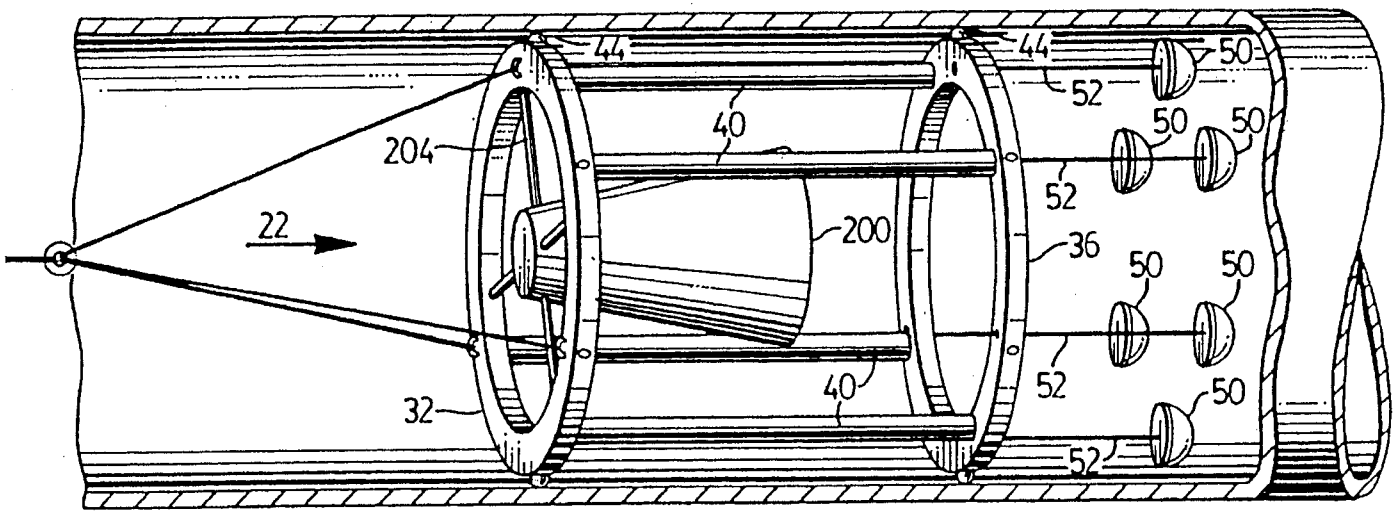
FIG. 6 illustrates a perspective view of another apparatus for removing an undesired coating from the interior of a tube which includes multiple impact heads.

FIG. 6 illustrates another embodiment of the present invention, which it is contemplated will be particularly suited for larger diameter tubes. As shown in the Figure, multiple impact heads 50 are provided. In this particular embodiment, six impact heads 50 are connected to one of six corresponding restraining cables 52, although it should be understood that the number of impact heads and corresponding restraining cables may be varied as required. For example, in a relatively small tube it may be desired to only employ two impact heads where in a relatively large tube it may be advantageous to employ eight or more.

Each restraining cable 52 is connected to aligning member 36 adjacent the interior surface of pipe 24 and each of the six impact heads 50 operates to impact and clean a portion of the interior surface of pipe 24.

As the restraining cables 52 are not pivoted about the center point of pipe 24, it is contemplated that the fluid flow through pipe 24 may not result in the required degree and type of chaotic movement of the impact heads 50 and, accordingly, a flow re-director may be employed as required. An example of such a flow re-director is shown in FIG. 6, in the form of a hollow cone 200 which is connected to a frame 204 attached across the center of aligning member 32. The longitudinal axis of re-director 200 is substantially aligned with the longitudinal axis of pipe 24 and flow re-director 200 effectively increases the fluid flow rate past the interior surface of pipe 24 and increases turbulence in the fluid flow in the region of impact heads 50. In this manner, the necessary fluid flow rate past each impact head 50 can still be obtained to provide proper chaotic movement of the impact heads 50.

It is contemplated that, while the smooth surface of the spherical portion 56 shown in FIGS. 1 through 6 will be effective in removing coatings such as zebra mussels, other coatings and conditions may benefit from other exterior surfaces. Accordingly, the exterior surface of the spherical portion 56 can be varied as required.

Figure 7:
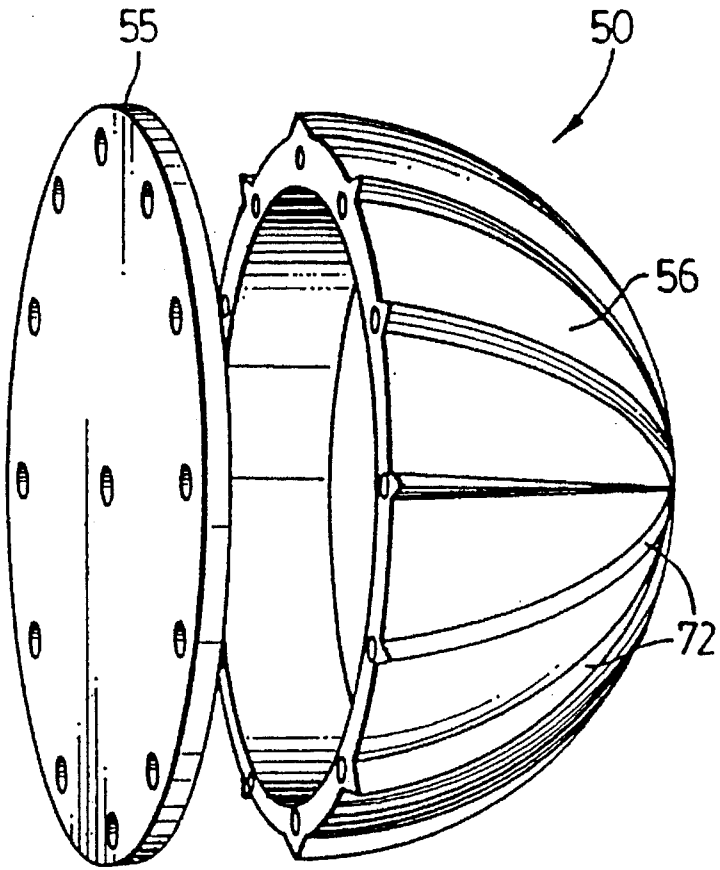
FIG. 7 illustrates a perspective view of another impact head with upstanding ridges.

For example, for coatings requiring a high impact force, upstanding ridges 72 may be provided on the exterior of the spherical portion 56 as shown in FIG. 7. Such ridges have the effect of decreasing the area over which the impact occurs, thus raising the impact force per unit area of impact. Alternatively, for coatings such as rust, a suitable abrasive material may be applied to the exterior of spherical portion 56.

When used in medical applications, such as to remove plaque from veins or arteries, or when removing relatively soft coatings such as seaweed, etc., cutter blades may be attached to the spherical portion 56. In this case, spherical portion 56 may be fabricated from surgical steel, nylon or other suitable materials with one or more embedded cutting surfaces or blades extending from the surface of spherical portion 56. The appropriate size and number of such blades would be apparent to one of skill in the art.

It should be understood that the present invention is not limited to the particular applications and embodiments described above and other applications and embodiments will be apparent to those of skill in the art upon further reflection. Such applications and embodiments should not be considered as departing from the spirit of the present invention.

Thus, the present invention provides a novel and effective apparatus and method for removing undesired coatings from the interior of tubes such as pipes or arteries. In particular, the present invention provides a practical method for the removal of undesired coatings from the interior surfaces of tubes. The present invention also provides an effective apparatus for accomplishing the method and the apparatus need only be run through the tube on a tether. No external power source nor complicated control systems are required by the apparatus thus allowing simplified construction and maintenance of the apparatus.

What is claimed is:

1. A method of removing a coating from an interior surface of a tube through which a fluid flows, comprising:

selecting a tube through which a fluid flows, said tube having an interior surface with a coating formed thereon;

placing a fluid-dynamically unstable impact head within said tube, said impact head capable of impacting said interior surface of said tube as a result of the fluid flow thereby removing the coating from said interior surface; flowing a fluid through said tube; and moving said impact head through said tube to remove said coating along the entire length of said tube.

2. A method according to claim 1, wherein said movement of said impact head is in the same direction as said fluid flow.

3. A method according to claim 1, wherein said movement of said impact head is in the opposite direction as said fluid flows.

4. A method according to claim 2, wherein said movement of said impact head is accomplished by paying out a tether attached to said impact head.

5. A method according to claim 3, wherein said movement of said impact head is accomplished by reeling in a tether attached to said impact head.

6. An apparatus for removing a coating from an interior surface of a tube through which a fluid flows, comprising:

a fluid-dynamically unstable impact head;

a centering means capable of being inserted into the tube to center said apparatus therein, said centering means being disposed upstream from said impact head;

a flexible restraining means connected between said impact head and said centering means, said flexible restraining means being sufficient length to enable said impact head to chaotically impact the interior surface of the tube to dislodge the coating therefrom when said apparatus is placed into the tube and the fluid is flowing therethrough; and, a tethering means attached to said centering means to control the longitudinal movement of said apparatus in the tube.

7. An apparatus according to claim 6 wherein said impact head includes a spherical portion with an upstream face, said flexible restraining means being connected to the center point of the upstream face.

8. An apparatus according to claim 7 wherein said upstream face is substantially planar.

9. An apparatus according to claim 7 wherein said spherical portion is a hemisphere and said upstream face is the disc of said hemisphere.

10. An apparatus according to claim 9 wherein the connection of said restraining means to said impact head allows free rotation of said impact head with respect to said restraining means.

11. An apparatus according to claim 9 wherein said impact head has a diameter of about 40 to about 80 percent of the interior diameter of said tube.

12. An apparatus according to claim 9 wherein said impact head has a cross-sectional area, normal to the direction of fluid flow through said tube, of about 50 to about 75 percent of the cross-sectional area of said tube normal to the direction of fluid flow through said tube.

13. An apparatus according to claim 7 further including a carriage moveable through said tube, the end of said flexible retaining means distal the impact head being attached to said carriage such that said end is maintained at substantially the center of said tube.

14. An apparatus according to claim 13 wherein said carriage is further connected to a tether.

15. An apparatus according to claim 14 wherein said carriage includes rollers to engage the interior surface of said tube.

16. An apparatus according to claim 14 wherein said carriage includes sliders to engage the interior surface of said tube.

17. An apparatus according to claim 7 wherein said impact head is substantially neutrally buoyant within said fluid flow.

18. An apparatus according to claim 7 further including one or more weights on said impact head, said weights being located on said impact head to alter the impact produced thereby.

19. An apparatus according to claim 7 wherein said impact head includes one or more raised portions to decrease an area on said impact head which impacts the interior surface of the tube.

20. An apparatus according to claim 7 wherein said impact head includes an abrasive coating.

21. An apparatus according to claim 7 wherein said impact head includes one or more abrasive members extending above the surface of said spherical portion.

22. An apparatus according to claim 7 further including a carriage moveable through said tube and a plurality of impact heads, each of said impact heads being connected to said carriage by a corresponding flexible restraining means, said flexible retaining being attached to said carriage adjacent its peripheral edge and at spaced locations along the perimeter thereof.

23. An apparatus according to claim 22 further including a re-director to increase the rate of fluid flow past said impact heads.

* * * * *